US005997657A

United States Patent [19]

Rademacher

[11] Patent Number: 5,997,657

[45] Date of Patent: Dec. 7, 1999

[54] METHOD FOR REMOVING DEBRIS FROM A HEARING AID

[76] Inventor: Steven T. Rademacher, 800 Yellowstone Ave., Pocatello, Id. 83201

[21] Appl. No.: 09/292,090

[22] Filed: Apr. 14, 1999

Related U.S. Application Data

[62] Division of application No. 08/715,991, Sep. 19, 1996, Pat. No. 5,898,972.

[51] Int. Cl.[6] ..... B08B 5/04; A47L 5/04

[52] U.S. Cl. ..... 134/21; 134/42; 15/341; 15/344

[58] Field of Search ..... 134/6, 21, 42; 15/341, 344, 303, 310; 228/20.1, 20.5

[56] References Cited

U.S. PATENT DOCUMENTS

| | | | |
|---|---|---|---|
| 454,720 | 6/1891 | Dexter | 15/344 |
| 3,604,610 | 9/1971 | Fortune | 15/344 |
| 3,842,240 | 10/1974 | Wakita et al. | 15/344 |
| 4,274,176 | 6/1981 | Undin et al. | 15/341 |
| 4,765,229 | 8/1988 | Fortune et al. | 15/341 |
| 4,901,391 | 2/1990 | Athalye | 15/3 |
| 5,081,739 | 1/1992 | Kao | 15/341 |
| 5,105,904 | 4/1992 | Olsen | 181/128 |
| 5,293,008 | 3/1994 | Danielson | 181/135 |

OTHER PUBLICATIONS

"AuraCare™ Hearing Aid Optimization System" brochure, Starkey Co., 6700 Washington Avenue South, Eden Prairie, MN, 1–800–328–8602 (No Publication Date).

*Primary Examiner*—Zeinab El-Arini
*Attorney, Agent, or Firm*—Ken J. Pedersen; Barbara S. Pedersen

[57] ABSTRACT

A hand held tool is used to remove cerumen and other debris through an existing aperture in a hearing aid by evacuating a tip placed in or over the aperture. In one embodiment, the tip is evacuated when a spring-loaded piston in a cylinder coupled to the tip is released to move quickly away from the aperture.

5 Claims, 2 Drawing Sheets

METHOD FOR REMOVING DEBRIS FROM A HEARING AID

This application is a divisional application of prior, application Ser. No. 08/715,991, filed Sep. 19, 1996, and now U.S. Pat. No. 5,898,972, entitled "Tool for Removing Debris from a Hearing Aid."

BACKGROUND OF THE INVENTION

1. Field of the Invention

Embodiments of the present invention relate to methods and systems for hearing aid maintenance.

2. Related Art

As an introduction to problems solved by the present invention, consider the conventional hearing aid pressed gently into the outer ear. The conventional hearing aid includes a diaphragm and sound output channel with an opening for broadcasting amplified sound from the diaphragm into the ear canal. The sound output channel, particularly the opening, is subject to the ingress of cerumen, loose skin, and other debris which can block the opening or the channel, degrading the output of amplified sound.

Conventional methods of maintaining a clear output channel include forming a cerumen removal mechanism into the body of the hearing aid, such as the earwax trap of Danielsen in U.S. Pat. No. 5,293,008, incorporated herein by reference. Such a device adds weight, complexity, and cost to each hearing aid. Other methods include table top equipment such as that supplied by Starkley under the trade name Auracare. The expense and bulk of such equipment, while appropriate for a business, prevent widespread acquisition by individuals. Still other known methods for cleaning hearing aids employ conventional pipe cleaners and drills of the type described in U.S. Pat. No. 4,901,391 to Athalye, incorporated herein by reference. Use of such devices exposes the hearing aid to a high risk of damage to the diaphragm, especially by those with less than normal eyesight or manual dexterity. These minor disabilities are common among the hearing impaired elderly.

Production of cerumen is sometimes increased when the outer ear is obstructed by the introduction of a hearing aid. The sound output channel, opening, and earwax traps of conventional hearing aids are easily blocked by cerumen. Without an inexpensive hand tool that reliably removes cerumen, wearers of hearing aids cannot by themselves easily maintain their substantial investment in hearing aids or enjoy the benefits of improved hearing without untimely interruption.

In view of the problems described above and related problems that consequently become apparent to those skilled in the applicable arts, the need remains for more reliable and economical methods and systems for removing cerumen from hearing aids.

SUMMARY

Accordingly, a hand tool for removing debris from within a hearing aid having an aperture, in one embodiment of the present invention, includes a tip that seals to the aperture, and a handheld system that evacuates air from the tip.

According to a first aspect of such an embodiment, cerumen is removed from the hearing aid through the aperture. Damaging contact of the diaphragm by tools used to remove cerumen is avoided.

According to another aspect, sufficient vacuum is created in a handheld system, simplifying storage, transportation, and use.

Debris is removed from within a hearing aid according to a method, in another embodiment of the present invention. The hearing aid has an aperture. The method uses a hand tool that has barrel having an opening and a piston within the barrel. The method includes the steps of grasping the hand tool; positioning the piston near the opening; placing the opening near the aperture; and moving the piston away from the opening.

According to a first aspect of such a method, a typical hearing impaired person holds a hearing aid in one hand while the tool is operated by the other hand. Ergonomically simple and reliable removal of debris results without development of a specialized skill.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

A person having ordinary skill in the art will recognize where portions of the figure have been expanded to improve clarity of presentation.

DETAILED DESCRIPTION OF THE PREFERRED EMBODIMENT

Figure 1:
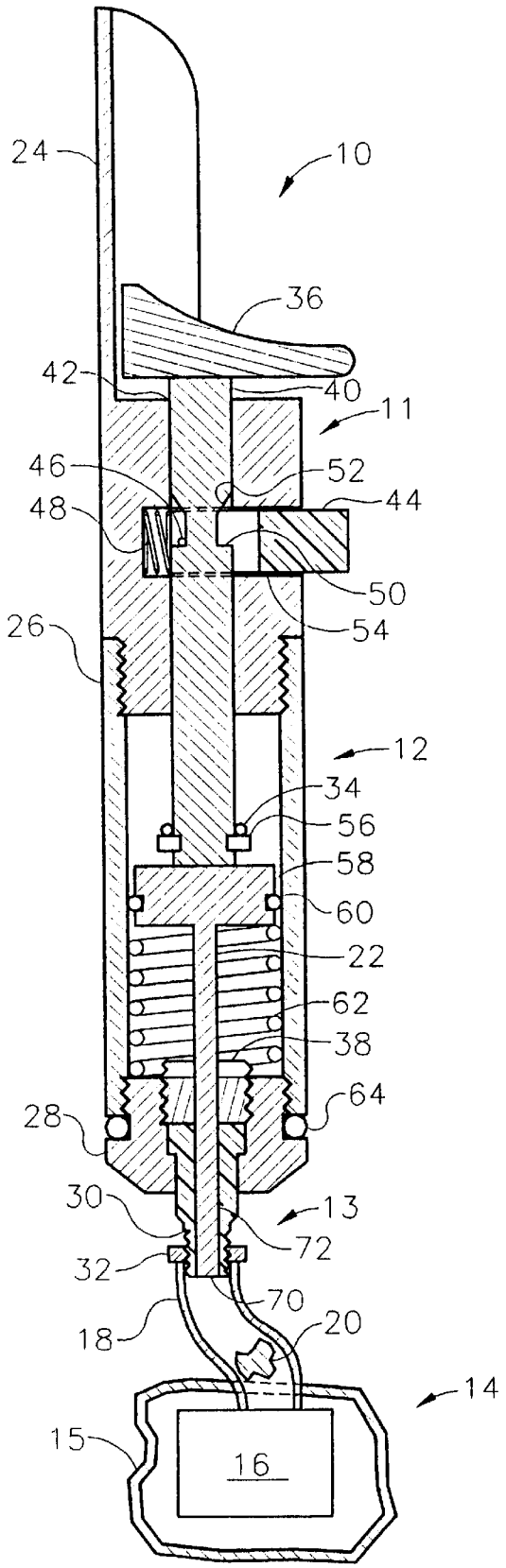
FIG. 1 is a cross section view of a tool in one embodiment of the present invention.

FIG. 1 is a cross section view of a tool in one embodiment of the present invention. Tool 10 is generally cylindrical and designed for reliable operation with one hand while supported by the same hand. As shown in FIG. 1, tool 10 is positioned and ready to restore operation of hearing aid 14.

Hearing aid 14, ordinarily separated from tool 10, includes case 15, receiver 16, and sound output channel tube 18. When hearing aid 14 is in use, tube 18 extends into the wearer's ear canal and case 15 remains in the outer ear. As shown, glob 20 of debris, including primarily skin and cerumen, has been introduced inadvertently into tube 18. Because glob 20 prevents sound radiated from receiver 16 into the ear canal, hearing aid 14 is non-functional until glob 20 is removed.

Tool 10 includes trigger assembly 11, piston assembly 12, and tip assembly 13. Trigger assembly 11 includes header 24, conventionally formed of impact resistant plastic. Header 24 includes a scoop shaped rear guide and a base having a central bore 41 and a radial bore 54. Thumb rest 36 is fixed to shaft 40 which slides axially within bore 42. Clip 56 is a conventional C-shaped clip that is frictionally engaged about a reduced diameter portion of shaft 40 to prevent removal of shaft 40 from bore 42. O-ring 34 is threaded onto shaft 40 between clip 56 and header 24 to dampen the impact of clip 56 against header 24 when shaft 40 is released.

Trigger assembly 11 also includes button 44 having a transverse pin 46 shown lodged against ledge 50 at an inner diameter of shaft 40. Shaft 40 and pin 46 are conventionally formed of stainless steel. Button 44 has a generally U-shaped cross section with pin 46 bridging the arms of the U. Button 44 is conventionally formed of high impact plastic.

Button 44 is urged outwardly from bore 54 by spring 48, but is prevented from being completely withdrawn from bore 54 by pin 46. Shaft 40 is released when button 44 is pressed inwardly against tension from spring 48 until pin 46 clears ledge 50 and allows shaft 40 to move quickly away from tip assembly 13, thus operating piston assembly 12.

Piston assembly 12 includes barrel 26, spool 58, O-ring 60, stem 22, and spring 62. Barrel 26 is conventionally formed of anodized aluminum providing a smooth interior finish. Spool 58 and stem 22 are conventionally formed of stainless steel for obtaining close reliable tolerances and rigidity.

O-ring 60 forms an air-tight seal between spool 58 and barrel 26 as spool 58 slides axially within barrel 26. Spring 62 is a conventional coil spring that bears against spool 58 forcing spool 58 against shaft 40. Spool 58 moves quickly away from tip assembly 13 when shaft 40 is released.

Tip assembly 13 includes stopper 38, guide 28, O-ring 64, tip 30, and nut 32. Stopper 38 and guide 28 are conventionally formed of tool grade aluminum, steel, or brass. Tip 30 is conventionally formed of plastic such as ultra high molecular weight (UHMW) poly-ethylene cast or machined with axial bore 72 and outer threads for nut 32. Tip 30 is designed for low friction support of stem 22 with resistance to wear. Stem 22 of piston assembly 12 is slidingly threaded into bore 72 through stopper 38, and tip 30.

Tip 30 is replaced by unscrewing guide 28 from barrel 26 and then unscrewing stopper 38 from guide 28. Debris from prior operation of tool 10 is removed from barrel 26 prior to reassembly of guide 28 onto barrel 26. O-ring 64 forms an airtight seal between guide 28 and barrel 26.

Tip 30 has an external thread that supports nut 32. Nut 32 is rotated to a predetermined setting for controlling the maximum insertion depth of tool 10 into tube 18. Damaging contact between stem 22 or tip 30 and receiver 16 is thereby avoided. Sound output channel tube 18 varies in length from one hearing aid type to another and sometimes varies between a right and a left ear application of hearing aids of a single type for an individual wearer.

Prior to operating tool 10 with a particular hearing aid, measurements are made to determine the proper setting for nut 32 on tip 30. Marks are made on nut 32 and on tip 30 for axial and radial matching alignment of nut 32 on tip 30. Two colors of markings are made to distinguish left and right hearing aid positions.

When shaft 40 is released, stem 22 is quickly withdrawn axially within bore 72 away from tip 30. Stem 22 operates to partially evacuate tip 30, thereby drawing glob 20 through the opening in tube 18, through bore 72 and into barrel 26. Spool 58 operates to partially evacuate the portion of barrel 26 enclosing spring 62. Because O-rings 60 and 64 seal barrel 26, stem 22 need not slide in perfect sealing relation to tip 30. The partial evacuation of barrel 26 improves the ability of tool 10 to pull glob 20 into tool 10.

In operation, piston assembly 12 has two stable positions. In a first position, as shown in FIG. 1, piston face 70 is flush with an outer surface of tip 30. In a second position, trigger assembly 11 has released shaft 40 and allowed piston face 70 to retract to a position near the interface between tip 30 and stopper 28. By failing to retract completely out of bore 72, misalignment of stem 22 and bore 72 is avoided. Additionally, the need to clean barrel 26 is reduced because most removed debris is discharged from bore 72 when piston assembly 12 is reset into its first position.

The foregoing description discusses preferred embodiments of the present invention, which may be changed or modified without departing from the scope of the present invention. Tool 10 is compatible with hearing aids located in the ear canal. A hearing aid conventionally includes electronic devices that amplify sound for hearing improvement. However the term hearing aid, as used herein, broadly includes any device introduced into the ear canal including sound absorption and blocking devices. Cleaning of such blocking devices is important to comfort, aesthetic appearance, and disease control.

Compatible hearing aids include an aperture. In many designs, this aperture through which debris is removed by tool 10, is the distal opening of the sound output channel tube. In other designs, the channel tube is removed or is not used and the aperture through which debris is removed is an aperture in the body of the hearing aid. In still other designs, the aperture is a vent, an adjustment access hole, or an opening for assembly, inspection, or aesthetic purposes.

Tool 10 evacuates tip 30 by quickly retracting piston face 70 within bore 72. Stem 22 as shown does not completely withdraw from bore 72 to preserve alignment of stem 22 in bore 72. In an alternate embodiment a shorter stem replaces stem 22. The shorter stem completely withdraws from bore 72 so that the vacuum created within barrel 26 improves the overall ability of the tool to draw glob 20 into the tool. In another alternate and equivalent embodiments tip 30 is a tube with a bore partially occupied by a piston or stem when in a position corresponding to the first position of tool 10. In such embodiments, the piston or stem need not perfectly fill the interior diameter of the tube. In such embodiments, the piston or stem need not extend the full axial length of the tube.

Figure 2:
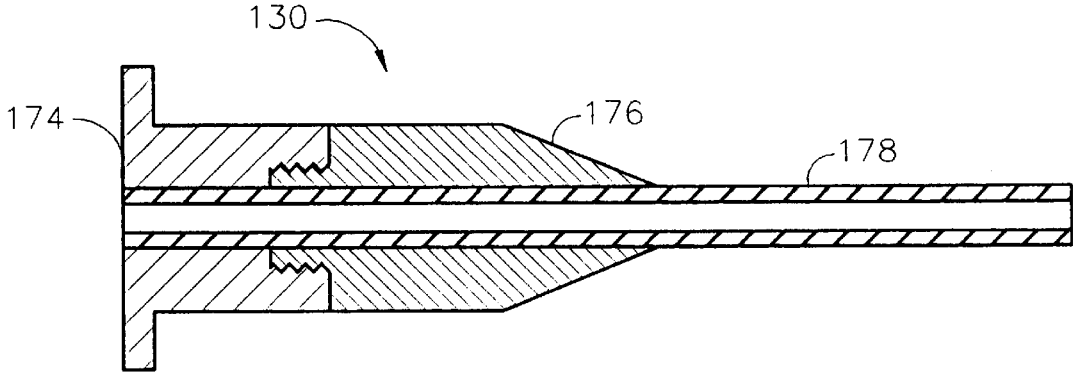
FIG. 2 is a cross section view of a tip in an alternate embodiment.

FIG. 2 is a cross section view of a tip in an alternate embodiment. Tip 130 replaces tip 30 with conventional mechanical modifications known to those of ordinary skill in the art. Tip 130 includes base 174, mid-section 176, and pipette 178. Both base 174 and mid-section 176 are conventionally formed of plastic. Mid-section 176 threads onto base 174, and provides means for replacing pipette 178 with alternate pipettes of different materials or different dimensions.

Pipette 178 is stainless steel in a preferred embodiment. The outside diameter and inside diameter of pipette 178 in a preferred embodiment allows for insertion into the aperture of a wide variety of hearing aids and for sufficient wall strength and evacuation capability. In one embodiment, pipette 178 is formed from a conventional gauge 16 to 20 veterinary needle. In a preferred embodiment, a 17 gauge needle is used.

Figure 3:
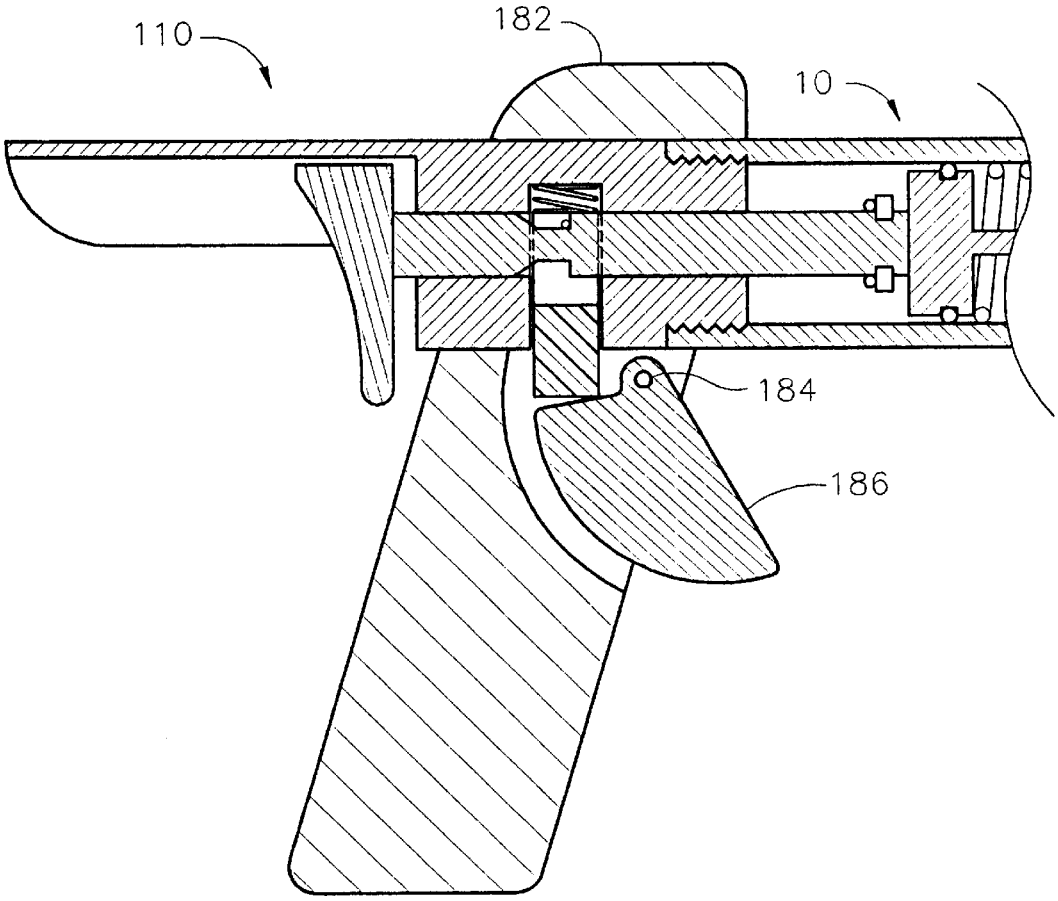
FIG. 3 is a cross section view of a tool in another embodiment of the present invention.

FIG. 3 is a cross section view of a tool in another embodiment of the present invention. Tool 110 includes tool 10 as already described with reference to FIG. 1. Tool 110 in addition provides a pistol grip handle including handle 182, trigger 186 and pivot 184. Pivot 184, and trigger 186 are conventionally formed of plastic. Although not preferred for its higher manufacturing cost, the barrel in such an embodiment is easier to direct and manipulate and the trigger in such an embodiment is easier to operate.

The outer diameter of tip 30 as shown in FIG. 1 is smaller than the inner diameter of sound output channel tube 18. In alternate and equivalent embodiments, nut 32 is omitted, the outer diameter of a tube or tip is made equal to or greater than the inner diameter of the aperture used for removing debris. In use of such an embodiment, no part of the tool intrudes within the hearing aid, thus avoiding the risk of damaging contact. In yet other embodiments, the function of nut 32 is performed by a fixed shoulder conventionally formed on the outer surface of a tube or tip.

Tip 30 in alternate embodiments is replaced with a tip having a surface and a bore through the surface. The surface is conventionally formed to seal against the aperture or be inserted into the aperture. Such alternate tips may take the form of a tube, hollow post, needle, syringe, pipette, or the like.

Although the preferred embodiment, shown in FIG. 1, evacuates the tip by removing the stem from within the tip by allowing a compressed spring to quickly relax, those of skill in the art will recognize alternate embodiments wherein spring tension is developed, i.e. energy is stored, in a spring when the spring is extended. The stem in such embodiments is removed by allowing the extended spring to quickly relax.

Still further, those of skill in the art will recognize means for evacuating tip 30 as primarily including piston assembly 12 operated in one linear motion from a first position to a second position. Alternate and equivalent means include an air pump integral to the hand tool. Operation of the pump in such embodiments involves repeated actuation with a valve for obtaining a decreasing pressure used to withdraw debris through the aperture. The arrangement of a hand powered or battery powered pump within a hand tool is considered the mere exercise of conventional mechanical design in light of the disclosure herein. In such an embodiment, the configuration of tip, nut, and the orientation of the tip near an aperture in the hearing aid are similar to the preferred embodiment illustrated in FIG. 1.

In FIG. 1, barrel 26 is cylindrical. In alternate embodiments a barrel of other convenient geometric cross section is used. In still another alternate embodiment, the barrel and trigger assembly are integral to a handle conventionally fashioned similar to a hand gun or similar to a paint spraying gun.

These and other changes and modifications are intended to be included within the scope of the present invention.

While for the sake of clarity and ease of description, several specific embodiments of the invention have been described; the scope of the invention is intended to be measured by the claims as set forth below. The description is not intended to be exhaustive or to limit the invention to the form disclosed. Other embodiments of the invention will be apparent in light of the disclosure and by practice of the invention to one of ordinary skill in the art to which the invention applies.

I claim:

1. A method for removing debris from within a hearing aid, the hearing aid comprising an aperture, the method comprising the steps of:

grasping a hand tool comprising a tip having a surface and a bore through the surface, a barrel in pneumatic communication with the bore, and a piston within the barrel;

positioning the piston within the barrel at a first position near the tip;

placing the tip near the aperture of the hearing aid so that the tip surface is at least partially sealed to an aperture wall defining the aperture so that the bore of the tip is in pneumatic communication with the aperture; and moving the piston to a second position away from the tip to form a partial vacuum within the tip and thereby drawing the debris toward the aperture and into the tip.

2. The method of claim 1, wherein the hand tool further comprises a spring mechanism with a spring in mechanical communication with the piston and the step of positioning the piston at a first position further comprises storing energy in the spring.

3. The method of claim 2, wherein storing energy in the spring comprises compressing the spring.

4. The method of claim 2, wherein moving the piston to the second position comprises operating a trigger on the hand tool to release the spring mechanism and release the stored energy and thereby moving the piston away from the tip.

5. The method of claim 4, further comprising moving the tool away from the hearing aid after operating the trigger and again moving the piston to the first position to discharge the debris from the tip.

* * * * *